US009163184B2

(12) United States Patent
Decoodt et al.

(10) Patent No.: US 9,163,184 B2
(45) Date of Patent: Oct. 20, 2015

(54) PROCESS FOR PRE-GENERATIVE REFORMING OF GASOLINES, COMPRISING RECYCLING AT LEAST A PORTION OF THE EFFLUENT FROM THE CATALYST REDUCTION PHASE

(75) Inventors: Xavier Decoodt, Carrieres S/Seine (FR); Sebastien Lecarpentier, Rueil Malmaison (FR); Pierre Yves Le Goff, Paris (FR)

(73) Assignee: IFP ENERGIES NOUVELLES, Rueil Malmaison Cedex (FR)

( * ) Notice: Subject to any disclaimer, the term of this patent is extended or adjusted under 35 U.S.C. 154(b) by 628 days.

(21) Appl. No.: 12/796,712

(22) Filed: Jun. 9, 2010

(65) Prior Publication Data

US 2010/0314288 A1 Dec. 16, 2010

(30) Foreign Application Priority Data

Jun. 10, 2009 (FR) ..... 09 02802

(51) Int. Cl.
*C10G 35/12* (2006.01)

(52) U.S. Cl.
CPC ..... *C10G 35/12* (2013.01)

(58) Field of Classification Search
CPC ..... C10G 35/04; C10G 35/10; C10G 35/12
USPC ..... 208/64, 133, 134, 140
See application file for complete search history.

(56) References Cited

U.S. PATENT DOCUMENTS

| | | | | |
|---|---|---|---|---|
| 3,516,924 | A * | 6/1970 | Forbes | 208/65 |
| 3,761,390 | A | 9/1973 | Greenwood et al. | |
| 3,992,465 | A | 11/1976 | Juguin et al. | |
| 4,613,423 | A * | 9/1986 | Swan et al. | 208/65 |
| 5,073,250 | A * | 12/1991 | Kline et al. | 208/65 |
| 5,203,988 | A * | 4/1993 | Swan et al. | 208/65 |
| 2001/0041816 | A1 * | 11/2001 | Brunet et al. | 585/440 |
| 2005/0214176 | A1 | 9/2005 | Brunet et al. | |

FOREIGN PATENT DOCUMENTS

FR 2 801 605 A1 6/2001

OTHER PUBLICATIONS

Search Report of FR 0902802 (Feb. 8, 2010).

* cited by examiner

*Primary Examiner* — Michelle Stein
(74) *Attorney, Agent, or Firm* — Millen, White, Zelano, Branigan, P.C.

(57) ABSTRACT

The present invention describes a process for regenerative reforming of gasolines, characterized by recycling at least a portion of the effluent from the catalyst reduction zone to the head of the last or penultimate reactor of the reaction zone. This arrangement can significantly improve the hydrogen balance of the unit and the production of reformate.

6 Claims, 3 Drawing Sheets

PROCESS FOR PRE-GENERATIVE REFORMING OF GASOLINES, COMPRISING RECYCLING AT LEAST A PORTION OF THE EFFLUENT FROM THE CATALYST REDUCTION PHASE

FIELD OF THE INVENTION

The invention relates to the field of processes for the catalytic reforming of gasolines.

This process uses a reaction zone comprising a series of 3 or 4 reactors operating in moving bed mode and has a catalyst regeneration zone which itself includes a certain number of steps, including an oxychlorination step and a final step for reduction of the catalyst with hydrogen.

After the regeneration zone, the catalyst is re-introduced to the head of the first reactor of the reaction zone.

More precisely, the invention pertains to a novel process for catalytic reforming of gasolines, comprising recycling the effluent from the catalyst reduction step to the head of the third reactor and/or the fourth reactor of the reaction zone.

This novel disposition has several advantages:

- it reduces or even eliminates the re-introduction of water into reactors 3 and 4;
- it favourably modifies the distribution of hydrogen between the various reactors by increasing the $H_2$/HC ratio on reactors 3 and 4, which are precisely those in which coke has a preferential tendency to form.

Finally, it can open up possibilities for managing the hydrogen purification section, since it becomes possible to carry out part of the work of the re-contacting compressor by the recycle compressor, i.e. in practice to reduce the number of stages in said re-contacting compressor.

Examination of the Prior Art

In the prior art, the reduction effluent from a catalytic reforming unit is generally sent either to the intake of the re-contacting compressor for the hydrogen purification section or to the fuel gas system, i.e. to the system for the gas used as a fuel in the various units or furnaces of the refinery which we shall hereinafter term the fuel gas system.

The reduction effluent may also be sent in its entirety or in part to the inlet to the separator drum in order to adjust the quantity of water in the recycle gas.

The flowsheets for the purification zone of the prior art are not modified by the present invention which essentially concerns the reaction zone. However, modifying the load of the recycle compressor means that it can be partially operated as a re-contacting compressor and thus can reduce the number of stages for said re-contacting compressor.

Patent FR 2 801 604 discloses a process for producing aromatics using a catalyst operating in moving med mode which comprises at least two steps characterized by a certain $(H_2)/(HC)$ ratio, $H_2$ representing the quantity of hydrogen introduced into said step, and HC representing the quantity of feed entering said step.

In the patent cited above, the catalyst reduction step is also characterized by a certain value for the $H_2$/HC ratio; the values for the $3H_2$/HC ratios, i.e. the two reaction steps and the catalyst reduction step, are connected by an inequality.

Patent FR 2 801 605 teaches a process for producing aromatics from a catalyst operating in moving bed mode which comprises a step for reduction of said catalyst in the presence of a recycle gas introduced in a quantity such that the quantity of pure hydrogen supplied is in the range 1 to 10 kg/kg of catalyst. The recycle gas is defined as resulting from dehydrogenation of at least a portion of the gaseous hydrogen-containing effluent.

Neither of these two patents, which may be considered to represent the nearest prior art, discloses in a precise manner the re-introduction of effluent from the catalyst reduction step to the head of the last reforming reactors.

BRIEF DESCRIPTION OF THE INVENTION

Figure 1:
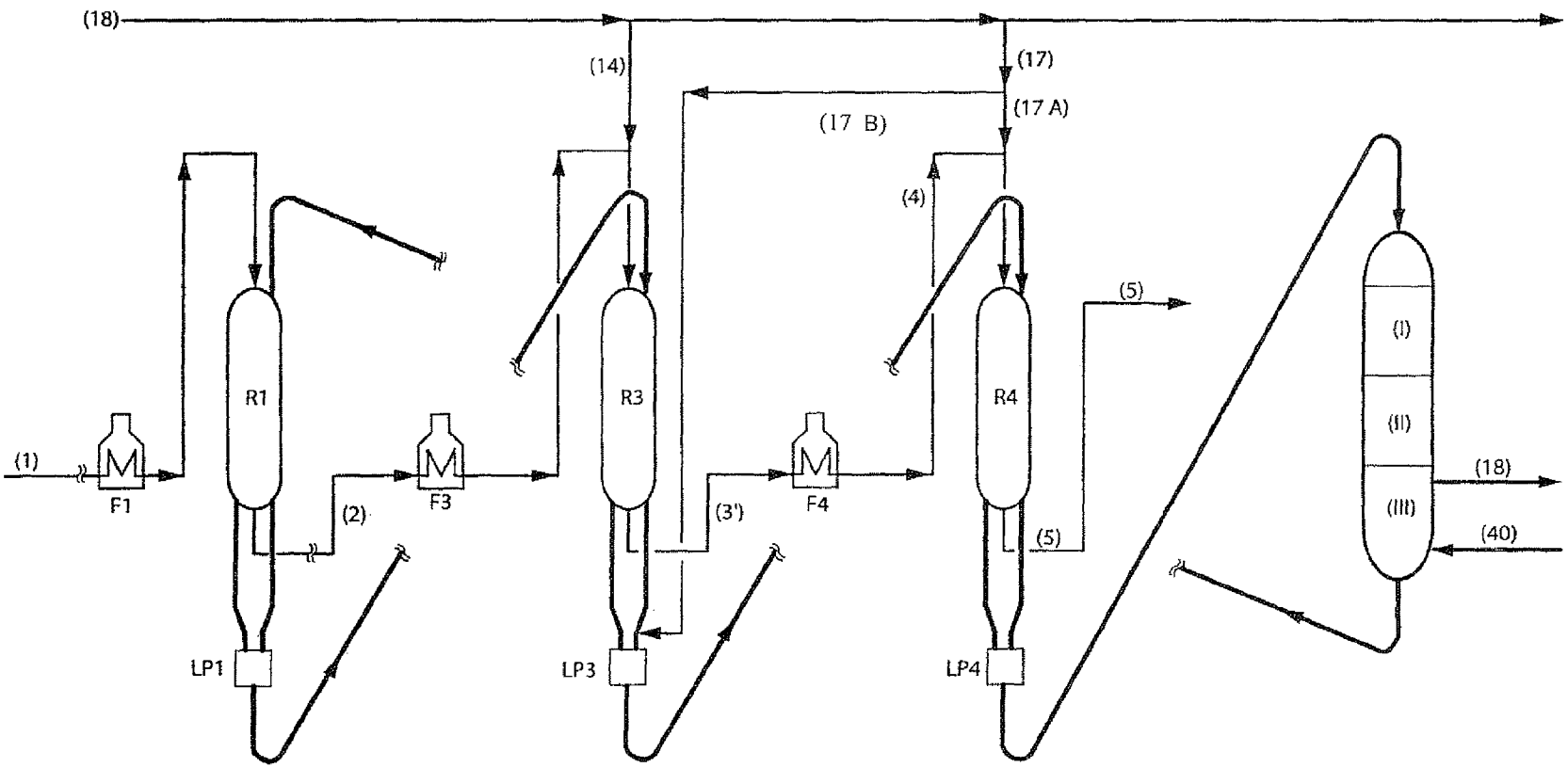
FIG. 1 represents a general view of a catalytic reforming unit comprising 4 reactors in series and a catalyst regeneration zone. The catalyst circuit is marked in thicker lines. Only R1, R2 and R4 are shown in FIG. 1.

The present invention may be defined as a process for catalytic reforming of a gasoline with a distillation range in the range 60° C. to 250° C., employing a moving bed catalytic reforming unit comprising three or four reactors in series, and a zone for regeneration of said catalyst, to which the effluent from the catalyst reduction step, forming part of the catalyst regeneration zone, is recycled:

- in the case of three reactors, to the head of the third reactor;
- in the case of four reactors, to the head of the third reactor and/or to the head of the fourth reactor.

The shortened formulation "and/or" should be construed to encompass the following two cases:

a) recycling the reduction effluent to the head of the third reactor;

b) recycling the reduction effluent to the head of the fourth reactor.

Cases a) and b) may be separate or may co-exist.

In a particular case of a process for catalytic reforming of the invention, when the unit comprises 3 reactors, the reduction effluent is recycled only to the head of the third reactor.

In another particular case of the process of the invention, when the unit comprises 4 reactors, the reduction effluent is recycled only to the head of the fourth reactor.

In another particular case of the process of the invention, when the unit comprises 4 reactors, the reduction effluent is recycled only to the head of the third reactor.

In the case of a unit comprising 4 reactors, the reduction effluent is in general recycled in part to the head of the third reactor and in part to the head of the fourth reactor.

In the case of a unit with four reactors, a portion of the reduction effluent may also be recycled to the transport gas at the transport pot in order to transport catalyst from the bottom of the third reactor to the head of the fourth reactor.

According to one flowsheet of the zone for separating reaction effluent resulting in reformate, the overhead stream from the separator drum (BS) is directed in its entirety to the recycle compressor (RCY).

According to another flowsheet of the zone for separating reaction effluent, a portion of the overhead stream from the separator drum (BS) is directed to the recycle compressor (RCY) and the other portion is directed to the re-contacting compressor (RCC).

The present invention is entirely compatible with the various possible flowsheets for the reaction effluent separation zone.

A number of techniques linked to recycling the reduction effluent to the head of the third and/or fourth reactors are observed:

- a first technical advantage corresponds to recapture of chlorine contained in the reduction effluent on the catalyst in reactors R3 and/or R4. This results in a substantial drop in the quantity of chlorine required to be injected into the regenerator in the oxychlorination step.
  In fact, during its sojourn in the reaction zone, the catalyst loses chlorine. However, the presence of chlorine in reactors R3 and R4 is essential. Recycling the reduction effluent to reactors R3 and R4 can thus substantially increase the activity of the catalyst in said reactors;
- a second advantage is linked to re-adsorption of the chlorinated compounds on the catalyst present in reactors R3 or R4. This effect of re-adsorption of chlorinated compounds also means that the consumption of chlorine downstream of the hydrogen re-contacting compressors can be reduced.

Further, it is known to the skilled person that the so-called "dry" operation of the reforming units is accompanied by a loss of selectivity by increasing the production of gas for the fuel gas system. The term "dry" operation is used when the operation of the unit is characterized by a low water content in the recycling gas and thus in the reaction zone.

Recycling the reduction effluent means that, via the water contained in the reduction effluent, the quantity of water in reactors R3 and R4 can thus be increased, and thus the selectivity of the catalyst in said reactors can be improved. Because the effluent reduction is recycled, injection of water into the feed can thus be reduced or even halted and it is possible to regulate the quantity of water introduced by adapting the flow rate of the reduction effluent recycled to the reactors R3 and R4.

Other technical advantages linked to the invention are generally observed:

- reducing the hydrogen blanketing of reactors R1 and R2, rendered possible by increasing the quantity of hydrogen in reactors R3 and R4, reduces the competition reaction between the hydrogen and the naphthenes, which has the result of improving the catalytic performances of reactors R1 and R2;
- the substantial increase in the hydrogen blanketing on reactors R3 and R4 entrains a substantial reduction in the quantity of coke at the outlet from the last reactor (R3 or R4 depending on the case);
- the reduction in the $H_2$/HC ratio on reactors R1 and R2 has the result of reducing the demand for utilities on the recycle compressor (RCY). The reduction effluent generally contains 99.9% by volume of hydrogen. Thus, by injecting upstream of reactors R3 and/or R4, the $H_2$/HC ratio corresponding to reactors R3 and/or R4 increases by approximately 0.1. This substantial increase in the h2/HC ratio in the reactors where the major portion of the coke is produced means that either the coke to be regenerated is reduced or, at iso-coke, the flow rate of the recycle gas to the reactors located upstream (i.e. reactors R1 and R2), can be reduced. Thus, a substantial gain in utility is obtained for the recycle compressor. Further, reducing the $H_2$/HC ratio on reactors R1 and R2 can increase the napthene dehydrogenation reactions in said reactors and reduce cracking of long chain paraffins;
- finally, the flexibility brought to the flowsheet for the hydrogen purification zone means that equipment costs for the hydrogen re-contacting compressor (RCC) can be reduced. The reduction effluent is generally returned to the hydrogen re-contacting compressor intake. In order to satisfy the pressure balance, the hydrogen re-contacting compressor intake (RCC) is attached to the overhead stream from the separator drum (BS), as is the case for the recycle compressor (RCY). When, in accordance with the present invention, the reduction effluent is recycled to reactors R3 and/or R4, this constraint no longer exists and the intake for the hydrogen re-contacting compressor (RCC) can be placed at the discharge from the recycled compressor (RCY). This saves one compression stage in the re-contacting compressor as the recycle compressor (RCY) then in part serves as the re-contacting compressor.

DETAILED DESCRIPTION OF THE INVENTION

A unit for catalytic reforming of gasolines comprises a reaction section constituted by three or four reactors denoted R1, R2, R3 and R4 operating in series, and a catalyst regeneration zone comprising a step (I) for combustion of coke deposited on the catalyst, a step (II) for oxychlorination allowing crystallites to be re-dispersed, and a step (III) for reduction in hydrogen which can reduce oxides of the catalyst before re-introducing it into the reaction zone.

The reaction zone is constituted by 3 or 4 reactors denoted R1, R2, R3, R4.

This catalyst reduction step generates a reduction gas, termed the reduction effluent in the remainder of the text, which in the prior art is re-introduced upstream of the recycle compressor (denoted RCY) or upstream of the separator drum (denoted BS).

In the present invention, this reduction effluent is recycled at least in part to the head of the third reactor R3, and optionally to the head of the fourth reactor R4.

The flowsheet for treatment of the effluent 5 from the reforming unit is not affected by the present invention and thus remains compatible with prior art flowsheet(s).

More precisely, in a catalytic reforming unit comprising three reactors, at least a portion of the reduction effluent is recycled to the head of this third reactor.

In a unit comprising four reactors, in the general case, at least a portion of the reduction effluent is recycled to the head of the third reactor R3 and the fourth reactor R4.

Preferably in the context of the invention, the reduction effluent 18 is recycled in its entirety to the head of reactor R3 (stream 14).

In another variation of the present invention, the reduction effluent 18 may be recycled in its entirety to the head of reactor R4 (stream 17*a*).

Finally, a portion of the reduction effluent (stream 17*b*) may be used as a transport gas at a transport pot LP3 which can lift the catalyst to the head of the reactor R4. The catalyst circuit as shown in thicker lines in FIG. 1 can be described as follows:

The catalyst from the regeneration zone, termed the regenerated catalyst, is introduced into the head of reactor R1.

It flows under gravity in reactor R1 were it encounters feed in the gaseous state which generally flows in a transverse manner with respect to the substantially vertical direction of flow of the catalyst.

The catalyst is recovered in a transport pot LP1 at the outlet from the reactor R1 in order to be lifted to the head of the reactor R2.

The catalyst is recovered in a transport pot LP2 at the outlet from the reactor R2 in order to be lifted to the head of the reactor R3. It is recovered in a transport pot LP3 at the outlet from the reactor R3 in order to be lifted to the head of reactor R4.

The catalyst is recovered in a transport pot LP4 at the outlet from the reactor R4 in order to be lifted to the regeneration zone (also termed the regenerator).

The catalyst is then regenerated in the regeneration zone which includes a step for combustion of coke deposited on the catalyst (I), an oxychlorination step (II), and a hydrogen reduction step (III).

At the outlet from the reduction step (III), the regenerated catalyst is re-introduced to the head of the first reactor R1 by means of a pneumatic transport system.

The hydrogen at the outlet from the reduction step (III) is termed the reduction effluent 18.

The effluent essentially concerns the recycle of said reduction effluent 18.

The general characteristics of the reduction effluent are as follows:

Pressure: 4.7 bar effective (1 bar=$10^5$ pascal) plus or minus 0.5 bar;

Temperature: 70° C. plus or minus 10° C.;

Hydrogen content: 99.9% by volume;

Chlorine content: 20-50 ppm by volume;

Water content: 50-100 ppm by volume;

Pressure at inlet to last reactor: 3.5 bar effective;

Inlet pressure upstream of last reactor: 4 bar effective.

Figure 2B:
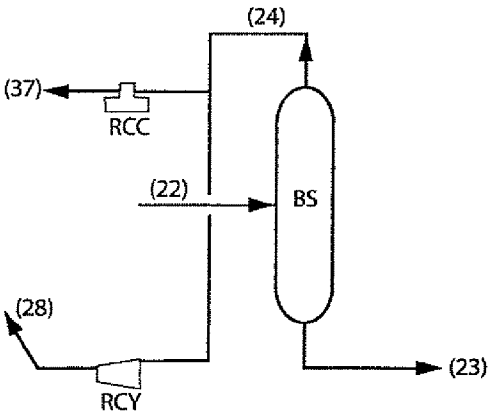
FIG. 2B shows another variation of the reaction effluent purification flowsheet which consists of sending a portion of the effluent from the head of the separator drum to the recycle compressor, and the other portion of said reaction effluent to the re-contacting compressor.
Figure 2A:
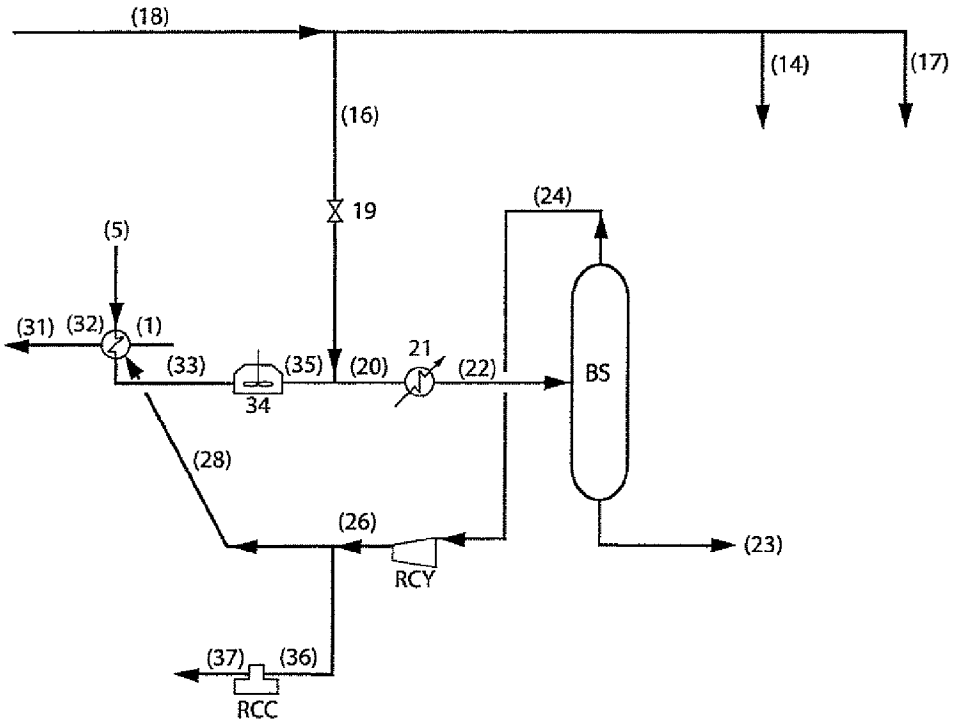
FIG. 2A shows a first variation of the reaction effluent purification flowsheet which consists of sending all of the effluent from the head of the separator drum to the recycle compressor.
Figure 3:
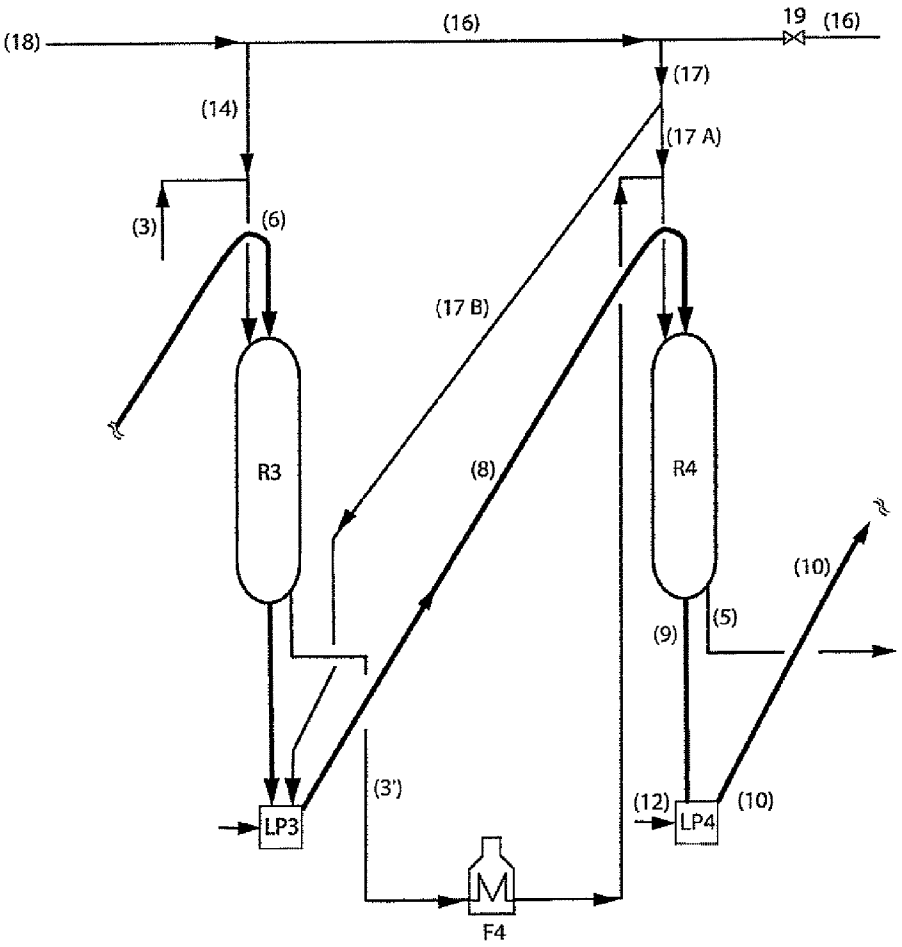
FIG. 3 is a more detailed view of the recycle for the reduction effluent, which in general comprises a first portion introduced to the head of reactor R3 mixed with the feed from said reactor R3, a second portion sent to the head of reactor R4 mixed with the feed 4 from said reactor, and optionally a third portion which may be mixed with a makeup of hydrogen to constitute the transport gas at the transport pot LP3.

The remainder of the detailed description will make reference to FIGS. 1, 2 and 3.

FIG. 1

FIG. 1 shows a configuration of a catalytic reforming unit with 4 reactors in which the reduction effluent 18 is recycled to the head of the third reactor R3 via line 14, to the head of reactor R4 via line 17*a* and to the base of the transport line joining the outlet from reactor R3 to the head of reactor R4 via line 17*b*.

This figure illustrates the 3 possible uses of the reduction effluent 18, but said reduction effluent may be sent in its entirety to the head of reactor R3 or to the head of reactor R4.

The reduction effluent 18 is recycled as a mixture with the supply line 3 for reactor R3, or as a mixture with the supply line 4 for reactor R4.

The feed 1 is introduced into the pre-heating furnace F1 before being introduced in the gaseous state into the reactor R1 where it is brought into contact with the catalyst coming from the regeneration zone which flows under gravity from top to bottom of reactor R1.

The effluent from the reactor R1 is introduced into the re-heating reactor F2 (not shown in FIG. 1) before being introduced to the head of the reactor R2 (not shown in FIG. 1).

The effluent from reactor R2 is introduced via line 2 into the furnace F3 which can bring it back up to the desired temperature, the reforming reactions being endothermic overall. The re-heated effluent from R2 is supplied to the head of reactor R3 via line 3.

The effluent from reactor R3, after re-heating in the furnace F4, is introduced into the head of reactor R4 via line 4.

The effluent from reactor R4 moves via line 5 towards the separation section which is described below with reference to FIG. 2.

The catalyst from the regeneration zone is introduced to the head of the reactor R1 in which it flows under gravity. It leaves R1 by means of a pneumatic transport system (LP1) and is brought up to the head of reactor R2.

The catalyst follows the same path in R2, R3 and R4.

At the outlet from R4, the catalyst is introduced to the head of the regeneration zone (Rg) which is shown in FIG. 1 as a 3-section regenerator, section (I) for coke combustion, section (II) to carry out oxychlorination, and section (III) for catalyst reduction.

At the outlet from reduction section (III), the catalyst is sent via a pneumatic transport system to the head of reactor R1 where it recommences a cycle.

The reduction gas 40 introduced into the reduction section (III) is generally constituted by hydrogen with a purity in the range 80% to 100% molar. This hydrogen derives from the hydrogen system existing in the refinery. It may also be constituted in part by the stream 37 leaving the re-contacting compressor (RCC) preferably following a purification treatment.

A portion of the effluent 18 from the reduction section, termed the reduction effluent, is recycled via the stream 14 to the head of reactor R3, with another portion being recycled via the stream 17, either to the head of reactor R4 via the stream 17A or towards the transport pot (LP3) via stream 17B.

Streams 14 and 17 can be divided up in any manner, but preferably all of the reduction effluent 18 is recycled to the head of reactor R3.

FIGS. 2A and 2B

FIG. 2A shows a flowsheet for purification of the reaction effluent in a base variation.

The portion of reduction effluent 18 moving via line 16 passes via a valve 19 then is mixed with reaction effluent 5 at the outlet from the last reactor of the reaction zone R4, moving via a line 35 after cooling in the exchanger 32 and air-cooled exchanger 34.

The resulting mixture of streams 35 and 18 produces the effluent moving via line 20 which passes via the water cooler 21 to supply the separator drum (BS) via line 22.

The separator drum (BS) produces a liquid stream moving via line 23 which is sent to a stabilization section (not shown in FIG. 2) to constitute the reformate produced by the reforming unit.

The gaseous stream moving via line 24 is compressed via the recycle compressor (RCY). The effluent from the recycle compressor (RCY) moving via line 26 is divided into an effluent moving via line 28 and an effluent moving via line 36.

The effluent from line 36 supplies the hydrogen re-contacting compressor (RCC) which produces an effluent 37 which is introduced directly into the hydrogen system or sent to a purification unit (not shown in FIG. 2).

The effluent moving via line 28 is sent to the heat exchanger 32. Said heat exchanger 32 is supplied with reforming feed which moves via line 1. The mixture of reforming feed which moves via line 1 and effluent moving via line 28 results in an effluent moving via line 31 which supplies the furnace F1 shown in FIG. 1, and constitutes the feed entering the reactor R1.

The effluent 5 from reactor R4 moves via line 30, passes through the heat exchanger 32 to produce the effluent moving via line 33 which supplies the air-cooled exchanger 34. At the outlet from the air-cooled exchanger 34, an effluent moving via line 35 is obtained which is mixed with the effluent 16 after the latter has passed through valve 19 to produce the stream moving via line 20.

In a variation of the flowsheet of the process shown in FIG. 2B, a portion of the overhead effluent 24 from the separator drum is sent directly to the re-contacting compressor (RCC) and another portion is sent to the recycle compressor (RCY). The effluent 37 from the re-contacting compressor is sent to the hydrogen system or to a purification unit (not shown).

The effluent 28 from the recycle compressor (RCY) is sent to the heat exchanger 32 as described for FIG. 2A.

FIG. 3

FIG. 3 shows a detailed view of reactors 3 and 4 with the device for recycling effluent from the reduction zone 18 for the catalyst of the invention.

The line 18 corresponds to the reduction effluent leaving the reduction zone (III) forming part of the catalyst regeneration.

- a first portion of the effluent 18 is introduced to the head of the reactor R3 via the line 14 mixed with the feed 3 from said reactor R3;
- a second portion of the reduction effluent 18 moving via line 17*a* is sent to the head of reactor R4 as a mixture with the feed 4 which is the reaction effluent from reactor R3, 3', after re-heating in the furnace F4;
- a third portion of the reduction effluent 18 may be mixed via line 17*b* with makeup hydrogen from line 11 to constitute the transport gas at the transport pot LP3 which can bring the catalyst leaving R3 towards the head of R4 via the transport line 8.

FIG. 3 also shows the outlet lines for catalyst, denoted 7 at the outlet from R3 and denoted 9 at the outlet from R4, the transport pots LP3 and LP4, the transport line 8 for catalyst from the outlet from R3 to the head of R4, and the transport line 10 for catalyst from the outlet from R4 to the regeneration zone (Rg).

Line 12 corresponds to the makeup of hydrogen to the transport gas for the transport pot (LP4).

COMPARATIVE EXAMPLE

The example below compares a basic case which corresponds to a catalytic reforming unit processing a feed at a flow rate of 300 $m^3$/h with the same unit of the invention, in which the catalyst reduction effluent is recycled to the head of the third and fourth reactors.

The unit comprised 4 reactors in series supplied with catalyst of type AR501 (trade name of AXENS NA), i.e. a platinum-based catalyst deposited on a silica-alumina support.

The feed to be treated was a gasoline cut with a distillation range of 90-170° C. in accordance with ASTM standard D86.

The $H_2O$ supply line corresponds to water introduced with the feed.

The $H_2O$ recycle line corresponds to water measured in the recycle gas.

The line denoted ΔC5+ corresponds to an increase in the flow rate of the reformate produced.

The effluent from the catalyst reduction zone was re-introduced to the head of reactors R3 and R4 in a proportion of 50/50.

The flow rate of the reduction effluent was 633 kg/h and the purity of said effluent was 99.9% by volume hydrogen.

TABLE 1

| | Base | Invention | Units |
|---|---|---|---|
| $H_2O$ supply | 4 | 1.4 | ppm by weight |
| $H_2O$ recycle | 20 | 20 | ppm by volume |
| Loss of chlorine | Base | −34% | Relative |
| H2/HC ratio on reactors R1 and R2 | 1.8 | 1.64 | Mol/mol |
| H2/HC ratio on reactors R3 and R4 | 1.8 | 1.9 | Mol/mol |
| Consumption of recycle compressor (RCY) | Base | −9% | Relative |
| ΔC5+ (wt %) | Base | +0.8% | Absolute |
| Consumption of re-contacting compressor (RCC) | Base | −1.5% | Relative |

It can be seen from comparative Table 1 above that the process of the invention can both provide a significant increase in the yield of the C5+ cut (termed the reformate), a very substantial decrease in the consumption of the recycle compressor (RCY) and a substantial reduction in the energy consumption of the re-contacting compressor (RCC). The reduction in the hydrogen blanketing for reactors R1 and R2 is rendered possible by increasing the quantity of hydrogen in the inlet stream to reactors R3 and R4; it rises from 1.8 to 1.9.

The repercussions of recycling the reduction effluent to the head of reactor R3 are a reduction in the $H_2$/HC ratio on reactors R1 and R2, which results in an improvement in catalytic performance of reactors R1 and R2.

The chlorine losses are also reduced due to recapture of chlorine contained in the reduction effluent on the catalyst in reactors R3 and R4.

This results in a substantial reduction in the quantity of chlorine which has to be injected into the regenerator in the oxychlorination step.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosures of all applications, patents and publications, cited herein and of corresponding French application No. 09/02.802, filed Jun. 10, 2009, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. In a process for catalytic reforming of a gasoline feedstock with a distillation range in the range 60° C. to 250° C., employing a moving bed catalytic reforming unit comprising four reactors in series wherein a moving bed of catalyst passes through said four reactors in series, and a zone for regeneration of said catalyst comprising a step for reducing catalyst with hydrogen, the improvement wherein effluent from the catalyst reduction step contains hydrogen, and the entirety of said effluent from said catalyst reduction step is recycled to the head of the third reactor and/or to the head of the fourth reactor, and the process further comprises passing product from the last reactor in series to a separator drum to separate liquid reformate from a gaseous overhead stream, passing said gaseous overhead stream in its entirety to a recycle compressor, passing a portion of the resultant compressed gaseous overhead stream to a re-contacting compressor, wherein the intake for the re-contacting compressor is connected to the discharge from the recycled compressor, recycling the compressed gaseous overhead stream leaving the re-contacting compressor to the reduction step;

mixing another portion of the compressed overhead stream leaving the recycled compressor with the gasoline feedstock to form a mixture; and supplying said mixture to the first reactor of said four reactors in series.

2. A process for catalytic reforming of a gasoline according to claim 1, wherein the reduction effluent is recycled only to the head of the third reactor.

3. A process for catalytic reforming of a gasoline according to claim 1, wherein the reduction effluent is recycled only to the head of the fourth reactor.

4. A process according to claim 1, wherein the catalyst comprises platinum on a silica-alumina support.

5. A process according to claim 1, wherein part of the reduction effluent is recycled to the head of the third reactor, and the remainder of the reduction effluent is recycled to the head of the fourth reactor.

6. A process according to claim 1, wherein the effluent from said catalyst reduction step contains 99.9% by volume hydrogen.

* * * * *